United States Patent [19]

Bertozzi

[11] 4,351,530

[45] Sep. 28, 1982

[54] PLASTIC BOWLING PIN

[76] Inventor: Albert Bertozzi, P.O. Box 478, Pawtucket, R.I. 02860

[21] Appl. No.: 201,291

[22] Filed: Oct. 27, 1980

[51] Int. Cl.[3] ..... A63D 9/00

[52] U.S. Cl. ..... 273/82 R; 264/249

[58] Field of Search ..... 273/82 R, 82 A, 82 B, 273/DIG. 4

[56] References Cited

U.S. PATENT DOCUMENTS

| | | | |
|---|---|---|---|
| 1,053,654 | 2/1913 | Seidel | 273/82 A |
| 3,044,777 | 7/1962 | Friedman | 273/82 R |
| 3,155,753 | 11/1964 | Weissman et al. | 273/82 R X |
| 3,169,766 | 2/1965 | Ernst | 273/DIG. 4 |
| 3,193,291 | 7/1965 | Cariani | 273/82 B |
| 3,231,274 | 1/1966 | Wanders | 273/82 R |
| 3,251,598 | 5/1966 | Craig et al. | 273/DIG. 4 |

FOREIGN PATENT DOCUMENTS

| | | | |
|---|---|---|---|
| 1361396 | 4/1964 | France | 273/82 R |

*Primary Examiner*—George J. Marlo

*Attorney, Agent, or Firm*—William F. Werner

[57] ABSTRACT

This specification discloses a bowling pin fabricated in three sections from plastic material having two different physical characteristics; the hollow top and bottom sections having approximately the same high density, same coefficient of restitution and same melt index, while the medial section is fabricated from plastic material having a greater density, a lower coefficient of restitution and a higher melt index, to permit spinning the top and bottom sections to the medial section, thereby to provide a plastic bowling pin with the physical characteristics of hard maple wood. A base plug may be secured to the bottom section.

2 Claims, 10 Drawing Figures

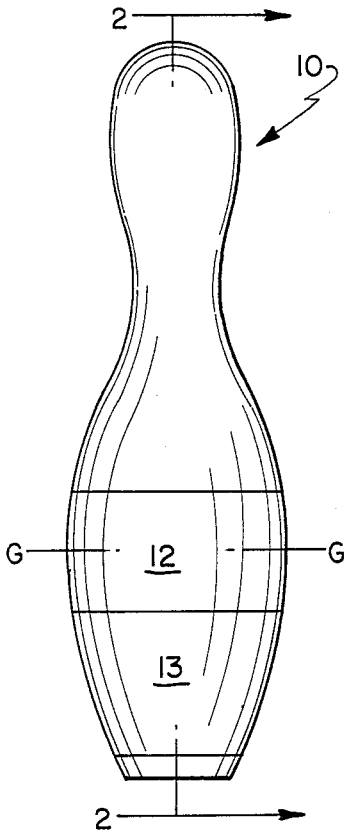
FIG. 1
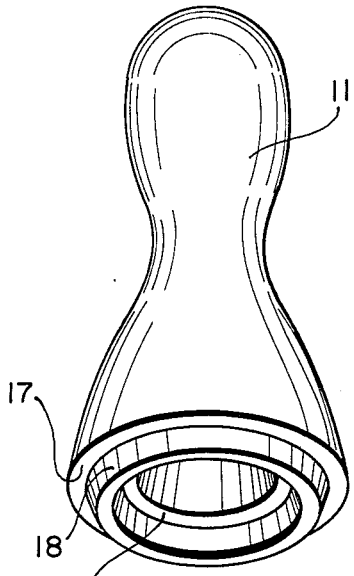
FIG. 3
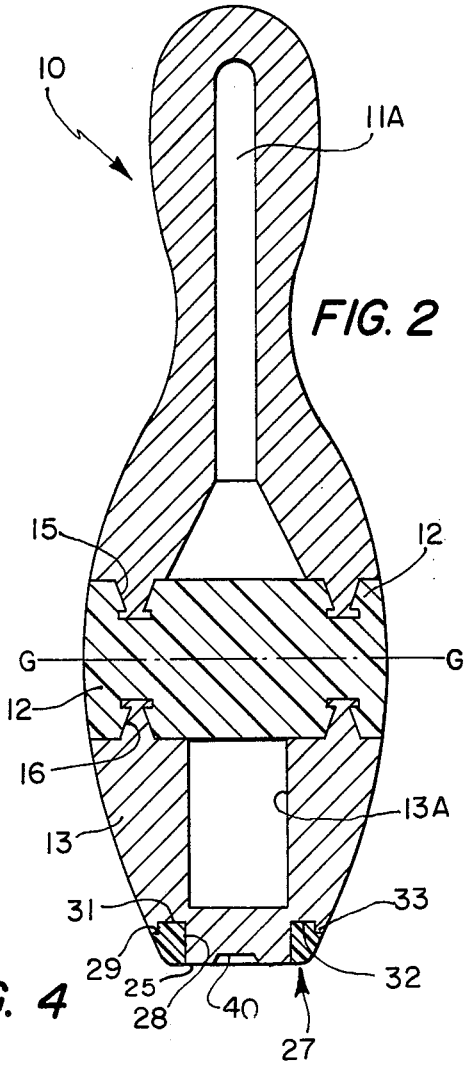
FIG. 2
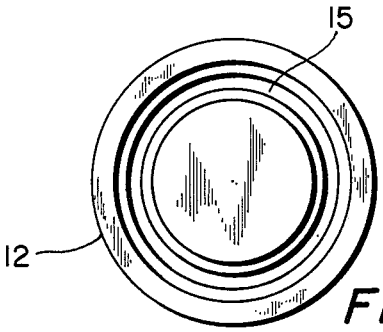
FIG. 4
FIG. 5
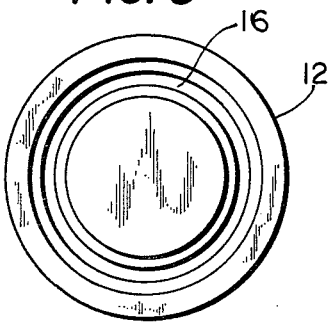
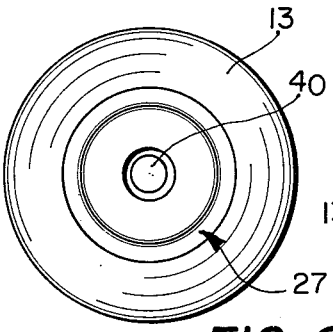
FIG. 6
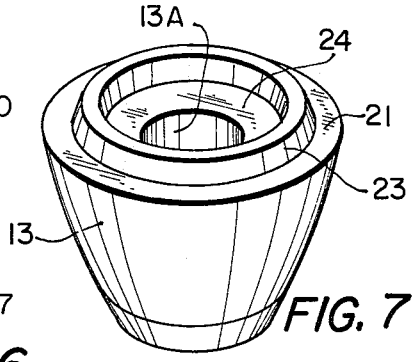
FIG. 7
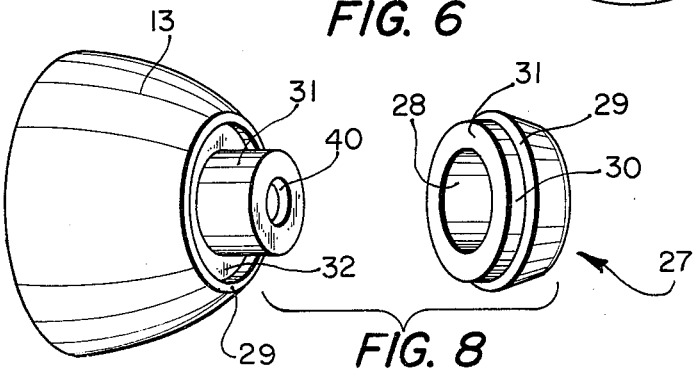
FIG. 8

PLASTIC BOWLING PIN

STATEMENT OF INVENTION

The present invention relates to bowling pins, and is concerned primarily with a bolwing pin of plastic that has all the properties, that are of vital interest to a bowler, of a wooden pin and which properties are imparted to the pin by structural characteristics thereof.

BACKGROUND OF INVENTION

The present invention is an improvement of U.S. Pat. Nos. 3,572,710 dated Mar. 30, 1971 and 3,984,104 dated Oct. 5, 1976.

Bowling is a sport now meeting with widespread acceptance. Bowlers, by virtue of years of experience with wooden pins, now expect certain properties of the pins with which they play. Perhaps the most important of these properties is the sound which comes from impact with a ball, impact with each other as the pins fly about, and engagement with adjacent alley structure. If a plastic pin is to meet with public acceptance, it is believed it must sound like a wooden pin and react like a wooden pin. This is especially true where tournament play is concerned.

The manner in which one pin affects another as it engages therewith after being forcibly removed from its position of rest by impact with a ball or other pin is also of importance from the aspect of scoring. The total number of pins which are felled by the delivery of a ball depends on the reaction of the pins with each other and with environmental alley equipment. All such reactions should be the same as those derived from wooden pins.

While plastic bowling pins have been proposed, it is believed that none of the now available plastic pins accommodate the above outlined factors to the degree necessary to accord to the plastic pins the widespread acceptance given to the wooden pins.

Accordingly, the present invention incorporates a new construction of the medial area of a tenpin located at the ball strike or impact zone to improve the sound quality of the pin and provide a lower coefficient of restitution of the pin body in that area to improve the scoring characteristics of the plastic bowling pin.

OBJECTS OF THE INVENTION

It is, therefore, an object of the present invention to provide a new construction in a plastic bowling pin, wherein the sound qualities and the scoring characteristics are improved.

And another object of the present invention is to provide a plastic bowling pin which has the properties of a wooden pin so far as the necessary physical characteristics are concerned.

Other objects of the present invention will be pointed out in part and become apparent in part in the following specification and claims.

BRIEF DESCRIPTION OF THE DRAWINGS

Referring to the drawings in which similar characters of reference indicate corresponding parts in all the figures:

FIG. 1 is a side elevational view of the new and improved bowling pin.

FIG. 2 is a vertical cross sectional view taken on line 2—2 of FIG. 1;

FIG. 3 is a perspective view of the top section;

FIG. 4 is a top plan view of the medial section;

FIG. 5 is a bottom plan view of the medial section of the new bowling pin;

FIG. 6 is a bottom plan view of FIG. 1;

FIG. 7 is a perspective view of the bottom section of the new bowling pin;

FIG. 8 is an exploded perspective view of the bottom section of the new bowling pin.

Figure 9:
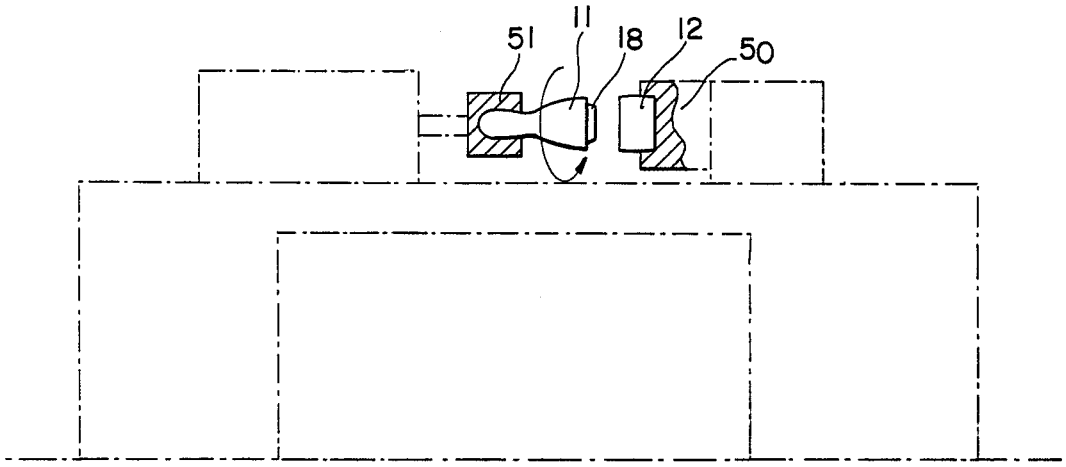
FIG. 9 is a diagrammatic view of the method of attaching the medial section to the top section of the new and improved bowling pin.
Figure 10:
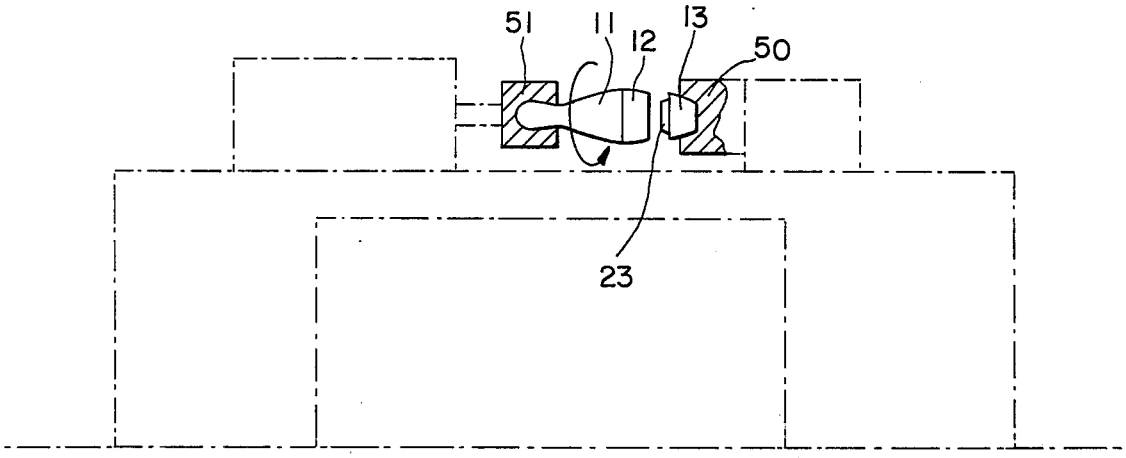
FIG. 10 is a view similar to FIG. 9 showing the method of attaching the medial area to the bottom section.

In proceeding with this invention, reference is made to the drawings, wherein is shown a plastic bowling pin, generally indicated by reference numeral 10, fabricated in three sections, top section 11, medial section 12 and bottom section 13. The three sections are fabricated from high density polyethylene, moulded separately and spin welded together.

A feature of the present invention is that the medial section 12 will be fabricated from high density polyethelene of less density and having a lower coefficient of restitution when moulded than either the top section 11 or bottom section 13 polyethelene material.

The three sections 11, 12, 13 when assembled will have an outer contour of curvature corresponding to that of a conventional bowling pin. Both the top section 11 and the bottom section 13 have hollow axial configurations 11A and 13A, respectively.

The medial section 12 will preferably be solid and will provide the center of gravity, line G—G at its girth or greatest diameter. Line G—G is also the horizontal strike or impact line of the bowling pin. The medial area 12 material must also be less dense than the material used to fabricate the bowling ball to prevent the bowling pin from deflecting the direction of travel of the bowling ball. In the event that the bowling ball and bowling pin are fabricated from material of the same density, the bowling pin, when struck by the bowling ball, would be deflected from the direction of the normal path of travel.

The medial section 12 is provided with an upper circular recess 15 having a key way or T-slot contour and a lower circular recess 16 also provided with a key way or T-slot configuration.

A shoulder 17 provides a circular flange 18 and a rim 20 in the lower end of top section 11. In like manner, a shoulder 21 provides a circular flange 23 and a circular edge 24 in one end of said bottom section 13.

As previously stated, the three pieces 11, 12, 13 will be moulded separately into the structures just described. A vise or holding fixture 50 will hold medial section 12 in a non-rotating position. A chuck 51 such as found on a lathe will securely hold the top section 11 in a position opposite the medial section 12 with the circular flange 18 opposite circular recess 15. The chuck 51 will rotate the top section 11, and press the flange 18 against circular recess 15. The friction generated by the speed of rotation of the top section 11 and engagement of flange 18 with recess 15 will cause the material of flange 18 to soften as the flange 18 enters recess 15, whereby the flange 18 will flow into recess 18 and thereby lock or permanently fasten flange 18 in recess 15 when rotation ceases and the material cools and hardens.

In like manner, holding fixture 50 will hold the bottom of section 13 in a non-rotating position. A chuck 51 will securely hold the combined top section 11 and medial section 12 in a position opposite the bottom section 13 with the circular flange 23 opposite lower circular recess 16. The chuck 51 will rotate the combined sections 11 and 12 and press flange 23 against lower circular recess 16. The friction generated by the speed of rotation of the combined sections 11, 12 and engagement of flange 23 with recess 16 will cause the material of flange 23 to soften as the flange 18 enters recess 16, whereby the flange 23 will flow into recess 16 and thereby lock or permanently fasten flange 23 in recess 16 when rotation ceases and the material cools and hardens.

Bottom section 13 has a base 25 upon which the assembled bowling pin 10 stands. The repeated act of knocking down and standing up the bowling pin 10 wears base 25 unevenly. If desired, a base plug, generally indicated by reference numeral 27 provided with an axial passageway 28, a ledge 29, a collar 30 and a seat 31 may be attached, as per a tight fit, to a bottom section 13. Bottom section 13 is provided with annular recess 32 and a shelf 33. Bottom section 13 is of a configuration to accommodate passageway 28 with seat 31 abutting annular recess 32 and ledge 29 abutting shelf 33. In this manner base plug 27 is removably secured to bottom section 13. A depression 40 may be provided in base element 31 to assist in the upright balance of bowling pin 10.

By way of example and not limitation, the high density, high molecular weight polyethelene is manufactured by American Hoechst Corporation and sold under the trade mark "HOSTALEN."

Top section 11 has a melt index of 0.1 and a density of 0.953 at 23° C. and a coefficient of restitution of 0.62 and polyethylene of a high molecular weight.

Medial section 12 has a melt index of 8.0 and a density of 0.959 at 23° C. and a coefficient of restitution of 0.60 and polyethylene of narrow molecular weight.

Bottom section has a melt index of 0.07 and a density of 0.953 at 23° C. and a coefficient of restitution of 0.62 and polyethylene of high molecular weight.

Having shown and described a preferred embodiment of the present invention, by way of example, it should be realized that structural changes could be made and other examples given without departing from either the spirit or scope of this invention.

What I claim is:

1. A plastic bowling pin, comprising three sections, a top section, a medial section and a bottom section, said three sections when assembled providing an outer contour of curvature corresponding to that of a conventional bowling pin, said top section having a hollow axial configuration and a shoulder, a circular flange and a rim in the lower end, said medial section having an upper circular recess provided with a key way contour, and a lower circular recess provided with a second key way contour, means fastening said circular flange in said first mentioned key way contour with said shoulder and said rim abutting said medial section, said bottom section having a hollow axial configuration and a shoulder, a circular flange and a circular edge in the top end, a second means fastening said last mentioned circular flange in said lower circular recess key way contour with said last mentioned shoulder and circular edge abutting said medial section, the top and bottom sections being fabricated from approximately the same high density polyethylene formulation and the medial section is fabricated from a high density polyethylene formulation having greater density and a lower coefficient of restitution than the polyethylene formulation used in fabricating said top and bottom sections, said medial section having a horizontal strike line which is the center of gravity of the plastic bowling pin and the girth of said medial section and the circular flange on each of said top and bottom sections having structural characteristics resulting from having been fitted into said key way contours by having been melted during a spinning operation and cooled.

2. The plastic bowling pin of claim 1 in which a base plug is provided with an axial passageway, a ledge, a collar, and a seat, said bottom section having an annular recess, a shelf, and a configuration to accommodate said axial passageway, with said seat abutting said annular recess and said ledge abutting said shelf and means fastening said axial passageway to said configuration.

* * * * *